United States Patent [19]

Lasker

[11] 4,337,507

[45] Jun. 29, 1982

[54] LIGHTING FIXTURE WITH DIRECTIONAL DISTRIBUTION

[75] Inventor: Martin L. Lasker, Edison, N.J.

[73] Assignee: The Marley-Wylain Company, Mission, Kans.

[21] Appl. No.: 47,799

[22] Filed: Jun. 12, 1979

[51] Int. Cl.[3] ..... F21V 7/00

[52] U.S. Cl. ..... 362/282; 362/290; 362/292; 362/300; 362/302; 362/346; 362/347; 362/367

[58] Field of Search ..... 362/282, 290, 292, 300, 362/302, 346, 347, 367

[56] References Cited

U.S. PATENT DOCUMENTS

| | | | |
|---|---|---|---|
| 3,358,133 | 12/1967 | Thoman et al. | 362/282 |
| 3,610,915 | 10/1971 | Moore | 362/282 |
| 3,697,893 | 10/1972 | Faustlin et al. . | |
| 4,096,555 | 6/1978 | Lasker | 362/302 |

OTHER PUBLICATIONS

Rambusch Lighting, Catalogue No. U-88, p. 1R-1, 1977.

A Catalog to Lighting Instruments, Elliptipar, Section A-1 to Z-7, Jan. 1977.

*Primary Examiner*—Stephen J. Lechert, Jr.

*Attorney, Agent, or Firm*—Lane, Aitken, Kice & Kananen

[57] ABSTRACT

In a lighting fixture, a light source is partially surrounded by a reflector system mounted in a housing to direct light from the light source out through an aperture in the front of the housing. The reflector is cylindrically and parabolically shaped to provide a cut-off above a selected vertical angle and to provide a decreasing intensity with decreasing vertical angles from a maximum intensity to effect uniform distribution. A lens is provided in the aperture to achieve uniform distribution through a wide horizontal angle. The reflector system and the light source are pivotable within the housing about a fixed horizontal axis to adjust the vertical cut-off angle and the angle of the maximum intensity. A fixed reflector is mounted near the top of the aperture on the front wall of the housing to get more sideways distribution of the light when the light source is pivoted toward the back of the housing. The lens is provided with vertically extending ribs to achieve horizontal distribution without effecting the vertical distribution or vertical cut-off characteristics achieved by the reflector system.

11 Claims, 16 Drawing Figures

LIGHTING FIXTURE WITH DIRECTIONAL DISTRIBUTION

BACKGROUND OF THE INVENTION

This invention relates to a lighting fixture and, more particularly, to an improved lighting fixture designed to project light uniformly distributed with a sharp cut-off above selected vertical angles and with the angle of the main beam projection and the angle above which the light is cut off adjustable.

Prior to the present invention, the most widely used lighting fixtures to provide directional light distribution were the industrial flood light and the prismatic unit. The industrial flood light permits the direction of the main beam to be adjusted, but does not provide any vertical cut-off. The prismatic unit reduces the amount of light which escapes at excessively high angles over that of the flood light, but it provides no sharp vertical cut-off and, in the prismatic unit, the vertical angle at which the main beam is projected is fixed and cannot be adjusted. In both the prismatic unit and the flood light, large amounts of light are allowed to escape at excessively high angles. This misdirected light is not only wasteful but is ecologically undesirable and highly detrimental to area visibility because of the glare that it produces. In addition, the lack of a cut-off angle in the flood light or a sharp cut-off angle in the prismatic unit will result in light trespass, which is unwanted illumination of surrounding areas.

The lighting fixture of the present invention improves dramatically on both of these prior art fixtures by providing a sharp cut-off angle with little wasted light and with relatively uniform light distribution over the illuminated area. The angle of the main beam of projection from the fixture from vertical is readily adjustable as is the vertical cut-off angle and this adjustment can be done without changing the position of the housing or lens of the fixture so that the lighting fixture has the same position as viewed externally for different vertical angles of projection and cut-off. Moreover, the preferred embodiment of the fixture produces a uniform horizontal distribution extending around the fixture and operates to provide some illumination behind the aperture of the fixture through which the light is projected so that when the fixture is mounted externally on a wall, illumination will be provided on the wall.

These advantages of the present invention are achieved by means of a reflector system which surrounds the light source having a generally cylindrical concave curvature above the fixture and having a parabolic curvature concave in two directions below the fixture. The specific shape of the reflector is selected to give the sharp vertical cut-off, to provide relatively uniform distribution of the light over the illuminated area, and spread the distribution of the light. The light is projected through an aperture in the housing in which is mounted a specially shaped lens projecting from the aperture. The lens serves to increase the uniformity of the distribution of the light and direct some of the projected light back behind the aperture. The lens provides the ribs on the vertically extending walls thereof so as to provide the desired distribution of the light through horizontal angles without interferring with the vertical cut-off of the fixture or the vertical distribution which is achieved by the reflector system. Near the top of the aperture, a second reflector is provided with a flat middle portion and with two ears projecting perpendicularly therefrom on either side of the arc tube of the lamp. The ears of this reflector provide for increased sideways illumination from the fixture and the flat middle portion serves to provide an image of the arc tube near the top of the aperture.

The reflector system, along with the lamp, is pivotally adjustable within the housing. This adjustment causes vertical adjustment of the main beam from the fixture and also will adjust the vertical cut-off angle. The angular adjustment causes the lamp to move back or forward in the housing. When the lamp is moved toward the back of the housing to provide higher angles of projection, the lamp would be moved too far away from the front of the fixture to provide good lateral distribution of light from the fixture. The auxilliary reflector mounted at the top of the aperture providing an image of the arc tube at this position serves to provide lateral distribution of light when the lamp is pivoted to the back of the housing.

DESCRIPTION OF THE PREFERRED EMBODIMENT

Figure 1:
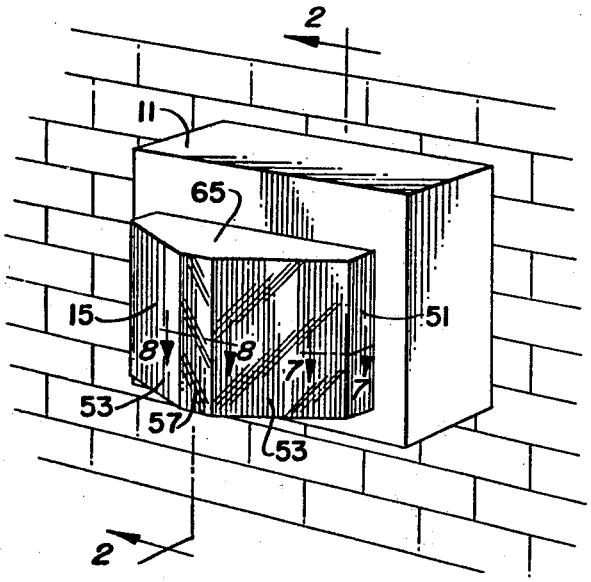
FIG. 1 is a perspective view of the lighting fixture mounted on a wall.
Figure 2:
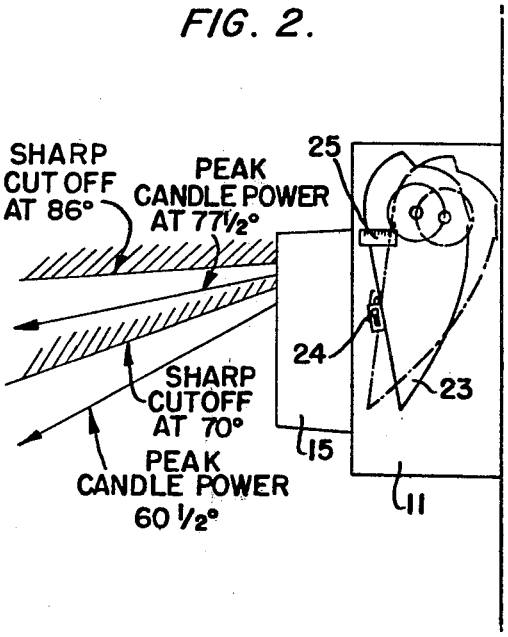
FIG. 2 is a schematic side view in elevation of the fixture illustrating the pivoting reflector arrangement and adjustability of the main beam and cut-off angles.

The lighting fixture of the present invention can be advantageously mounted on a wall, as shown in FIG. 1, but can be mounted recessed in a wall, pole-mounted, top-mounted from a ceiling or any convenient mounting. The fixture comprises a housing 11, a fixed lens 15 mounted in an aperture in the front of the housing, a lamp 19 having a linear light source in the form of an arc tube positioned just above the aperture extending horizontally parallel the plane of the aperture in the housing, and a concave combined cylindrical and parabolic reflector system 23 extending around the light source mounted in the housing. The reflector system 23 is angularly adjustable about a horizontal axis extending parallel to the axis of the light source, as illustrated in FIG. 2. The lamp 19 is fixed to and pivots with the reflector system 23.

The reflector system is shaped to provide a sharp cut-off angle from vertical which is adjustable with the position of the reflector between 70 degrees and 86 degrees. The reflector arrangement provides a peak intensity or main beam preferrably at an angle of 9½ degrees below the cut-off so that this peak intensity beam is adjustable between 60½ degrees and 77½ degrees with the adjustments of the angular position of the reflector and light source combination. The main beam angle should be no greater than 15 degrees below the cut-off angle. The angular position of the reflector system 23 is locked in position by means of a locking screw 24. A scale 25 provides an indication of the cut-off angle for the angular position selected for the reflector system 23.

Figure 4:
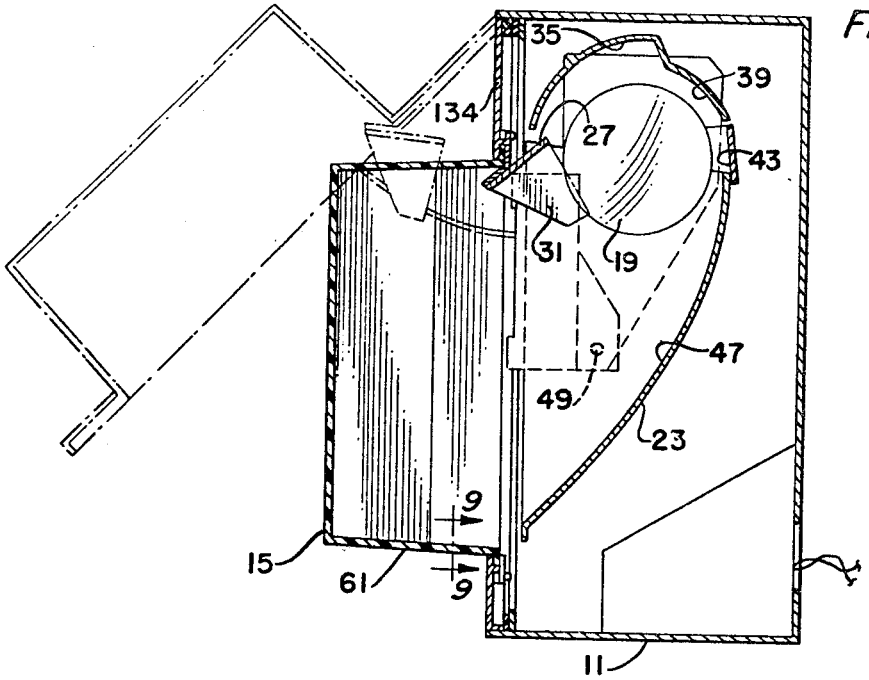
FIG. 4 is a sectional view of the fixture shown in side elevation.
Figure 5:
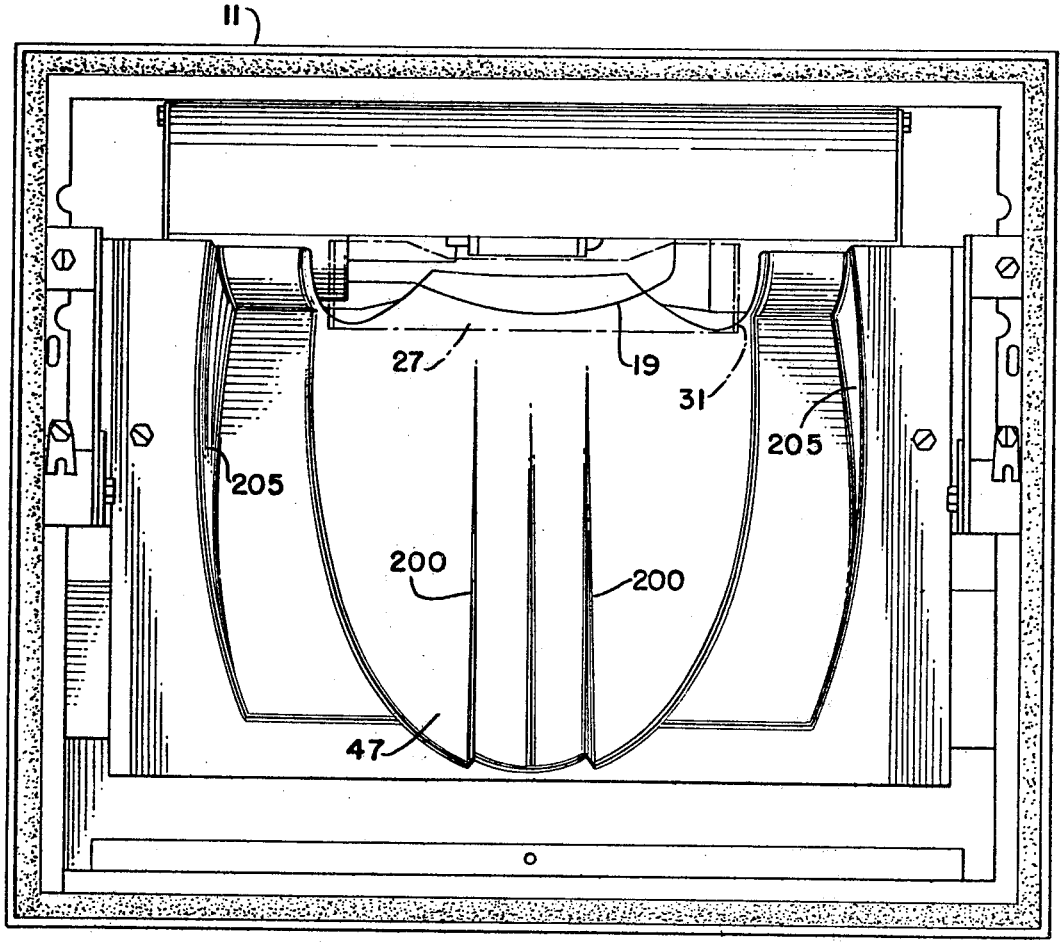
FIG. 5 is a front view in elevation of the fixture with the front wall and lens of the fixture removed.

As shown in FIG. 4 and in phantom in FIG. 5, an additional flat reflector 27 is fixed to the housing 11 on the front wall thereof positioned in a plane parallel to the axis of the light source at an angle of 45 degrees from horizontal and extending at the upper end to just higher than the position of the light source. At each end of the reflector 27 are two reflecting ears 31 which extend back toward the arc tube at each end thereof perpendicular to the reflector 27. The upper front reflecting surface of the reflector system 23, designated by the reference number 35, may be cylindrically curved about the arc tube as may be the upper rear reflecting surfaces 39 and 43. However, preferably these surfaces are concavely curved in the horizontal direction to reduce the amount of light escaping out of the sides of the fixture. The upper reflecting surfaces 35 and 39 produce an image of the arc tube along side the arc tube and project light down to a lower parabolic concave curved reflecting surface 47 of the reflector system 23. The parabolic surface is also concave in the horizontal direction to improve horizontal distribution. The adjustment of the reflector system 23 is about a horizontal axis 49 and the lamp 19 being fixed to the reflector system 13 adjusts with the reflector system about this axis.

Figure 3:
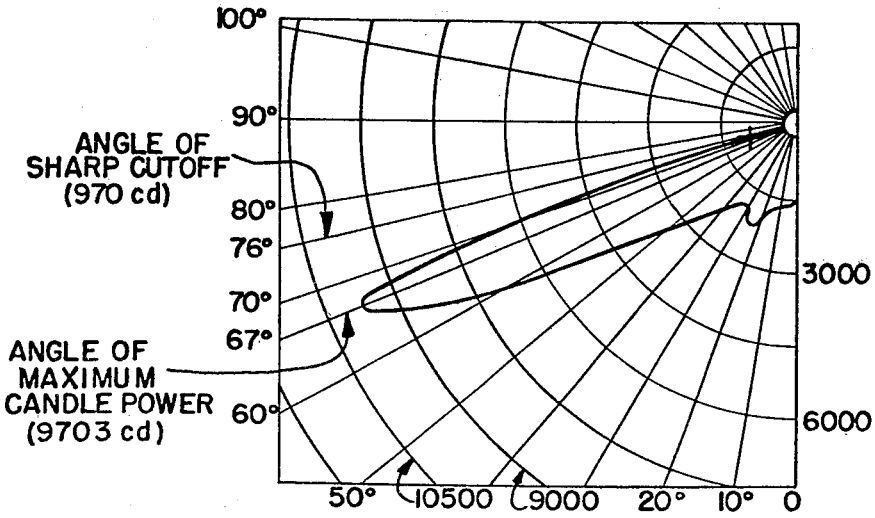
FIG. 3 illustrates how the intensity of the light projected varies with changes in vertical angles from the fixture.

In addition, the reflector system 23 produces a light distribution ranging from vertical with the maximum intensity adjustable between 60½ degrees and 77½ degrees and progressively decreasing intensity toward downward vertical. The manner in which the light distribution varies with changes in the vertical angle is illustrated in the light distribution curve in FIG. 3. This light distribution curve achieves a substantially uniform illumination of the illuminated area.

The details of the lower portion of the reflector system 23, or, in other words, the parabolic reflecting surface 47, are illustrated in FIGS. 13–17. On these figures, contour lines of equal elevation are shown in phantom to fully illustrate the curvature of the reflector. The step change in elevation moving from the center of the reflector toward the sides of the reflector at 200 is to reduce dark patches that would otherwise occur in the light distribution. The outer side edges of the reflector are stepped back at 205 and increases the size of the aperture defined by the reflector and the width of the surface areas from which the light is reflected.

The reflector system 23 operating with the light source 19 alone will tend to spread the light though an angle of 130 degrees and would tend to produce variation in the intensity of the light projected at different horizontal angles from the fixture. The lens 15 serves to widen the horizontal distribution and achieve uniform distribution at different horizontal angles, as well as to provide illumination at extreme wide angles, and illumination behind the aperture of the housing 11 in which the lens 15 is mounted so that the unit will illuminate the wall behind it on which it is mounted as shown in FIG. 1. The lens has two vertical side sections 51 at the sides of the aperture in which the lens 15 is mounted perpendicularly from the plane of the aperture and two vertical sections 53 extending from the side sections 51 obliquely to join a vertical center section 57 extending parallel to the plane of the aperture. The oblique sections 53 extend at an angle of 22 degrees from the plane of the aperture. The lens also has a horizontal bottom section 61 extending from the bottom of the aperture to join the bottom edges of the sections 51, 53 and 57. The corresponding top section of the lens 65 is made translucent, but is not an operative part of the lens since no light is transmitted through this portion of the lens. The sections 51, 53 and 57 contain parallel vertical ribs which, in the portions 53 and 57, horizontally distribute the light to provide uniform horizontal distribution of the light and the sections 51 distribute and project the light back behind the aperture.

Figure 7:
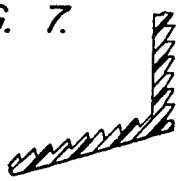
FIG. 7 is a sectional view taken through the lens along line 7—7 of FIG. 1 illustrating the rib structure of this portion of the lens.
Figure 8:
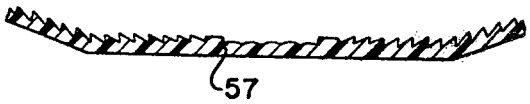
FIG. 8 is a sectional view taken through the lens along lines 8—8 in FIG. 1 illustrating the rib structure of this portion of the lens.
Figure 9:
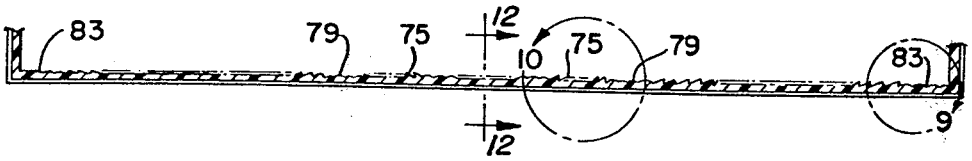
FIG. 9 is a sectional view taken along line 9—9 in FIG. 4 to illustrate the rib structure of this portion of the lens.
Figure 10:
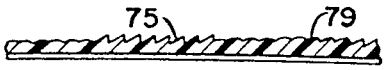
FIG. 10 is an enlarged view of the portion delineated by the circle 10 of FIG. 9.
Figure 11:
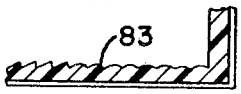
FIG. 11 is an enlarged view of the portion delineated by the circle 11 of FIG. 9.
Figure 12:
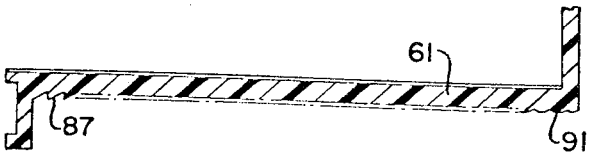
FIG. 12 is a sectional view taken through the lens along line 12—12 in FIG. 7 to illustrate the further details of the rib structure of the lens.
Figure 6:
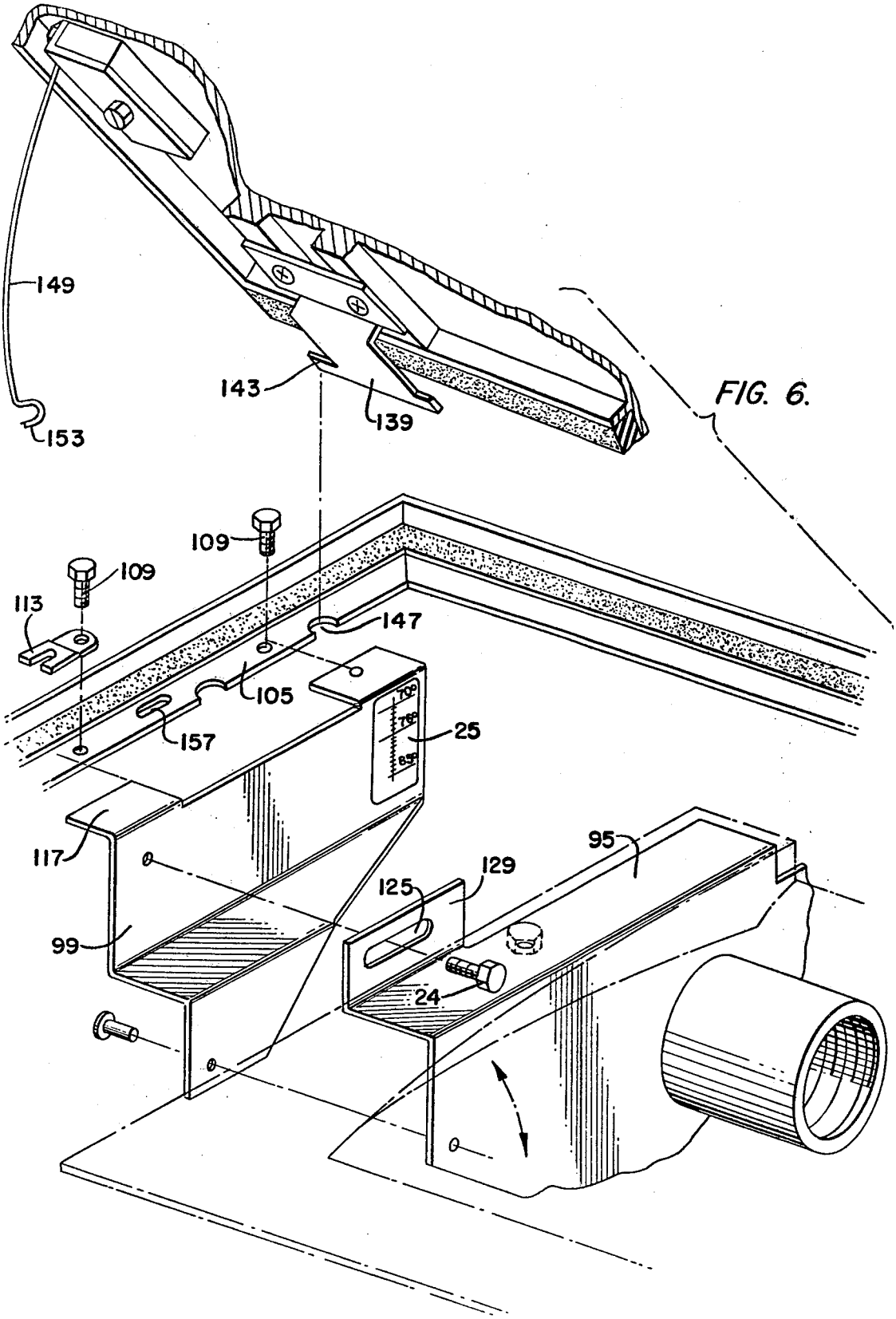
FIG. 6 is an exploded view illustrating the details of how the front wall pivotally mounts on the housing and also illustrating the pivotal mounting of the reflector system.
Figure 13:
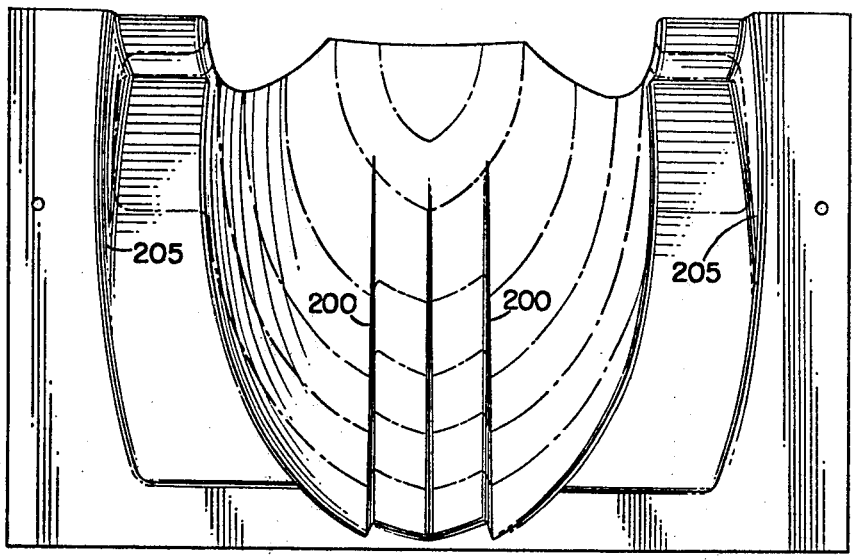
FIG. 13 is a front view in elevation of the lower parabolic portion of the adjustable reflector system and containing contour lines to illustrate the curvature of this reflector.
Figure 14:
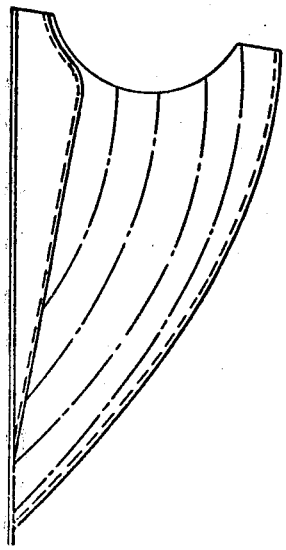
FIG. 14 is a side view in elevation of the lower parabolic portion of the adjustable reflector system also containing contour lines to illustrate the curvature of the reflector.
Figure 15:
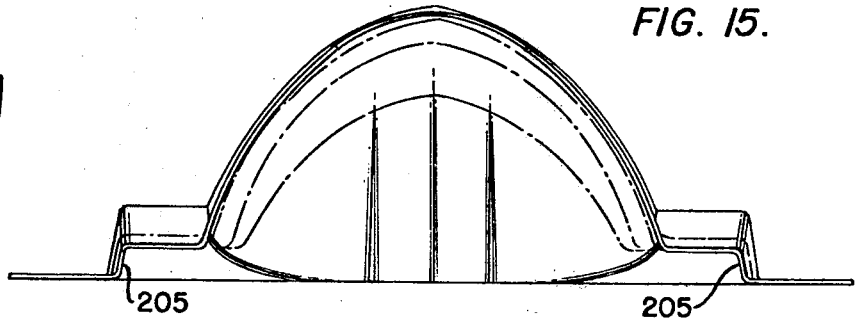
FIG. 15 is a top plan view of the lower parabolic portion of the reflector system containing contour lines illustrating the curvature of the reflector.
Figure 16:
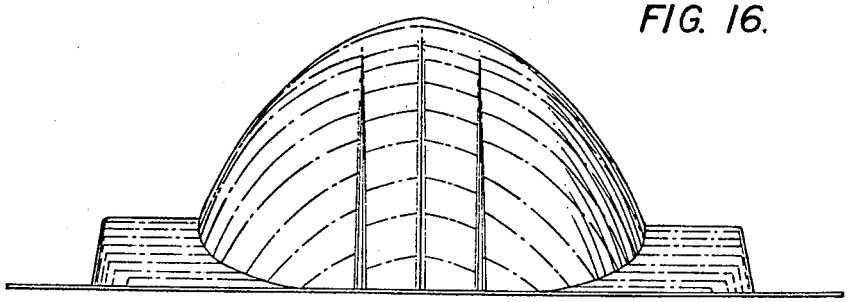
FIG. 16 is a bottom plan view of the lower parabolic section of the reflector system containing contour lines to illustrate the curvature of this portion of the reflector system.

The vertical ribs on the sections 51 are saw-toothed in shape as illustrated in the sectional view shown in FIG. 7 and are formed on the outside surface of the lens. The vertical ribs in the sections 53 are also saw-toothed in shape as shown in FIGS. 7 and 8 and are formed on the inside surface of the lens with the outside surface of these portions being flat. The vertical ribs formed on the outside surface of the center section 57 are rounded with relatively mild relief in the center and are saw-toothed with relatively severe relief at the sides of the section 57, as shown in FIG. 6. The shape of the ribs, as shown in FIG. 8, was selected to achieve a uniform horizontal distribution. The bottom section 61 of the lens has ribs on the inner surface thereof extending out perpendicularly from the aperture in which the lens is mounted and has ribs on the outer surface thereof extending parallel with the plane of the aperture. The effect of these ribs is to distribute the light generally vertically below the fixture in both directions. The ribs formed on the inner surface vary in shape, with the variation in shape symmetrical about the center section line 12—12 of FIG. 9. The center portion of these ribs, as illustrated in the enlarged view of FIG. 10, are rounded with relatively mild relief and adjacent to this portion is a saw-tooth portion 75. Adjacent to the saw-tooth portion 75 is another rounded mild relief portion 79. At the sides of the section 61, the ribs on the inner surface are rounded with relatively mild relief in portions 83 as shown in the enlarged view of FIG. 11. Between the portions 79 and 83, the ribs have the same saw-tooth shape, as best shown in FIG. 11. The ribs on the outside of the lower section 61 of the lens extending parallel to the plane of the aperture have a saw-tooth shape with relatively high relief near the aperture as shown at 87 in FIG. 12 and change gradually to be rounded with relatively mild relief at the outer portion of the section 61, as shown at 91 in FIG. 12. The ribs on the inner surface of the lower section 61 distributes the light over the surface directly beneath the light laterally from the fixture and the ribs on the outer surface of the section 61 distribute the light over the surface in the area vertically below the fixture perpendicularly to the plane of the aperture including behind the aperture. The particular shape of the ribs, illustrated in FIGS. 7–12, are selected to achieve uniform distribution over the area generally vertically below the fixture.

It will be observed that when the reflector system 23 is pivoted to the position shown in phantom in FIG. 2, the lamp 19 moves toward the back of the housing as the fixture pivots. This would normally result in the light source moving too far away from the lens for the lens to be able to provide sufficient light distribution at the sides of the fixture and behind the aperture as is desired. To overcome this problem, the reflector 27 is provided. The reflector 27, in effect, provides an image of the arc tube which is fixed near the aperture and stays in this position even though the light source 19 moves backward as the reflector system is pivoted. This fixed image of the light source provided by the reflector 27, together with the ears 31, provide a substantial amount of light illumination at the side of the fixture and behind the aperture even when the light source 19 moves toward the back of the housing.

The lens illustrated in the drawings is the preferred lens for the fixture giving maximum lateral distribution of the light. When broad lateral distribution is not needed, the reflector system can be used with a flat lens covering the aperture. The flat lens will employ some vertical ribs to help achieve uniform horizontal distribution.

As best illustrated in FIG. 6, the reflector system 23 is mounted on a bracket 95 which is pivotally mounted at each side thereof on a fixed bracket 99 by means of rivets 103. The brackets 99 are mounted on supporting shelf 105 by means of screws 109 and a clamp member 113 which overlaps the projection 117 of the bracket 99. The angular position of the bracket 95 and, therefore, the lens system 23, can be held in position by means of the set screw 24 threaded into the bracket 99 and passing through a slot 125 defined in a projection 129 on the bracket 95. The scale 25 is provided on the bracket 99 and the position of a flat front surface of the reflector system 23 on the scale 25 indicates the cut-off angle for that angular position of the reflector system.

The front wall 134 of the casing, which defines the aperture in which the lens 15 is mounted, is pivotable out from the top of the casing, as shown in FIG. 4. Since the reflector 27 with its ears 31 is mounted on the front wall, this reflector pivots with the front wall away from the lamp 19 to permit easy changing thereof. With the front wall 134 in position closing the casing, the reflector 27, together with the ears 31, provides for practically completely surrounding the lamp, thereby permitting very little of the light being wasted inside the casing. Thus, a very efficient light projecting arrangement is provided.

The pivoting arrangement of the front wall 134 is best illustrated in FIG. 6. As shown in FIG. 6, brackets 139 are mounted in each upper corner of the front wall 134. Each bracket 139 has a projecting ear 143 which passes through the groove 147 to be under the shelf 105. In addition, a spring steel latch arm 149 is mounted at the side of the front wall 134 spaced from the top thereof and has a hook 153 at the outer end thereof. The arm 149 extends through a slot 157 defined in the shelf 105. When the front wall 134 is closed, the ear 143 will slide up under the shelf 105 to the upper corner thereof and the bottom of the front wall 134 is held in position by means of a screw, not shown. When the front wall is pivoted out, as shown in phantom in FIG. 4, the ear 143 slides under the arm 105 toward the groove 147 and the latch arm 149 comes out of the slot to a position where the hook 153 engages around the bottom side of the slot 157 and latches the front wall 134 in the pivoted out position so that the lamp 19 can be changed. To remove the front wall entirely from the remainder of the casing, it is merely necessary to spring both of the latch arms 149 upwardly to permit the hooks 153 to disengage and come through the slots 157 and the ears 143 will come out through the grooves 147.

The above described fixture is of a preferred embodiment of the invention and modifications may be made thereto without departing from the spirit and scope of the invention, which is described in the appended claims.

I claim:

1. A lighting fixture comprising a housing having an aperture defined in one side thereof, a light source mounted in said aperture, a reflector system partially surrounding said light source and positioned and shaped to project light through said aperture with a main beam of highest intensity projection at a selected angle from downward vertical and with a selected angle of vertical cut-off, the angular position of said reflector system being relative to said housing adjustable about a horizontal axis to adjust the selected angle from downward vertical of said main beam and the selected angle of vertical cut-off, and a lens positioned in said aperture fixed relative to said housing and having a portion thereof shaped to distribute the light rays passing through said aperture horizontally without changing the vertical distribution of light passing through said aperture.

2. A lighting fixture as recited in claim 1, wherein said lens includes vertically extending light transmitting sidewalls having vertically extending ribs defined in at least one surface thereof.

3. A lighting fixture as recited in claim 2, wherein said lens includes a horizontal section extending perpendicularly from said aperture at the bottom thereof having parallel ribs extending in one direction at one surface thereof and parallel ribs on the other surface thereof extending in another direction, the ribs on said horizontal section being shaped to provide a relatively uniform distribution of light on the surface generally vertically below said fixture.

4. A lighting fixture as recited in claim 1, wherein said lens has two vertical sections extending perpendicularly to the plane of said aperture at the sides of said aperture and having vertically extending ribs to distribute light horizontally behind said aperture.

5. A lighting fixture as recited in claim 1, wherein said horizontal axis is below said light source and wherein said light source is fixed relative to said reflector system so that said light source pivots about said horizontal axis with said reflector system and wherein there is provided mounted on said housing a fixed reflector positioned to produce an image of the light source of said lamp near the top of said aperture.

6. A lighting fixture as recited in claim 5, wherein said fixed reflector is planar and is positioned in a plane extending parallel to the axis of said light source.

7. A lighting fixture as recited in claim 6, wherein said fixed reflector has two reflecting ears extending back on either side thereof from said planar reflector on opposite sides of said light source.

8. A lighting fixture as recited in claim 5, wherein said aperture is defined in a front wall of said housing which is pivotal out from the remainder of said housing, said fixed reflector being mounted on said front wall so as to pivot out and away from said lamp when said front wall is pivoted out from said housing.

9. A lighting fixture as recited in claim 1, wherein there is provided means defining a scale fixed to said housing, said reflector system including means pivoting with said reflector system and moving over said scale to provide an indication of said selected angle of vertical cut-off.

10. A lighting fixture as recited in claim 1, wherein said reflector system includes an upper reflector section shaped to focus an image of the light source adjacent to said light source and said reflector system includes a lower parabolic section extending below said reflector to receive light reflected from said upper reflector section, said lower parabolic section being curved to be concave in two directions.

11. A lighting fixture comprising a rear housing section defining an opening and a front wall adapted to close said opening, a light source mounted in said housing and a reflector system positioned to project light from said source through an opening in said front wall, said rear housing section having shelves extending along the sides of said opening and said front wall portion closing against said shelves, said front wall having brackets mounted thereon having ears positioned to extend under said shelves through grooves formed in said shelves positioned to receive said ears to secure one side of said front wall to said rear portion of said housing while permitting said front wall to pivot out with respect to said rear portion of said housing, a pair of spring steel latch arms mounted on the front wall of said housing and received in slots defined in said shelves, said latch arms having hooks defined in the ends thereof to engage the ends of said slots when said front wall is pivoted out from said housing to hold said front wall in the pivoted out position, said latch arm extending through said slots with said hooks disengaged from said ends of said slots when said front wall closes the opening defined by said rear housing portion.

* * * * *